US010130837B2

(12) United States Patent
Grimaud et al.

(10) Patent No.: US 10,130,837 B2
(45) Date of Patent: Nov. 20, 2018

(54) MULTI-PURPOSE EXERCISE DEVICE

(71) Applicant: TruForce Fitness, LLC, Palatine, IL (US)

(72) Inventors: Brian Grimaud, Palatine, IL (US); Greg Janicki, Port Byron, IL (US)

(73) Assignee: TRUFORCE FITNESS, LLC, Palatine, IL (US)

( * ) Notice: Subject to any disclaimer, the term of this patent is extended or adjusted under 35 U.S.C. 154(b) by 106 days.

(21) Appl. No.: 15/196,768

(22) Filed: Jun. 29, 2016

(65) Prior Publication Data

US 2016/0375294 A1 Dec. 29, 2016

Related U.S. Application Data

(60) Provisional application No. 62/186,070, filed on Jun. 29, 2015.

(51) Int. Cl.
*A63B 21/00* (2006.01)
*A63B 21/04* (2006.01)
(Continued)

(52) U.S. Cl.
CPC ..... *A63B 21/072* (2013.01); *A63B 21/0442* (2013.01); *A63B 21/0552* (2013.01); *A63B 21/0557* (2013.01); *A63B 21/4035* (2015.10); *A63B 23/03525* (2013.01); *A63B 23/1209* (2013.01); *A63B 23/1236* (2013.01); *A63B 21/1618* (2013.01); *A63B 21/1645* (2013.01); *A63B 23/03508* (2013.01); *A63B 23/03533* (2013.01); *A63B 23/1254* (2013.01); *A63B 23/1263* (2013.01); *A63B 69/0071* (2013.01); *A63B 2023/003* (2013.01); *A63B 2023/0411* (2013.01); *A63B 2069/0006* (2013.01); *A63B 2209/02* (2013.01); *A63B 2225/09* (2013.01); *A63B 2244/08* (2013.01)

(58) Field of Classification Search
CPC ..... A63B 21/0004; A63B 21/055–21/0557; A63B 23/1236
See application file for complete search history.

(56) References Cited

U.S. PATENT DOCUMENTS 8,556,781 B1 * 10/2013 Fitzpatrick ..... A63B 21/0724 482/106
2007/0238578 A1 * 10/2007 Landfair ..... A63B 21/072 482/44

(Continued)

*Primary Examiner* — Jennifer M Deichl
(74) *Attorney, Agent, or Firm* — Nyemaster Goode, P.C.

(57) ABSTRACT

A multi-purpose fitness bar capable of being asymmetrically weighted. The fitness bar has a frame consisting of three arms, multiple handholds and elevated risers. The handholds are in a multitude of positions and angles to provide variability in training. Each arm is capable of being independently loaded with one or more removable weights to produce a symmetric or asymmetric weight load to provide increased torque with movement of the device as well as driving the body in movement patterns consistent with function. The elevated risers provide a space between the body of the device and floor to provide "push-up" function of the device by protecting the users hands from contact with the ground. The arms of the device may also provide attachments for resistance band use to provide another loading mechanism for strength development.

17 Claims, 9 Drawing Sheets

(51) Int. Cl.

| | |
|---|---|
| ***A63B 21/055*** | (2006.01) |
| ***A63B 21/072*** | (2006.01) |
| ***A63B 21/16*** | (2006.01) |
| ***A63B 23/035*** | (2006.01) |
| ***A63B 23/12*** | (2006.01) |
| *A63B 69/00* | (2006.01) |
| *A63B 23/00* | (2006.01) |
| *A63B 23/04* | (2006.01) |

(56) References Cited

U.S. PATENT DOCUMENTS

2014/0200119 A1* 7/2014 Sides, Jr. ..... A63B 21/0618
482/106
2016/0144220 A1* 5/2016 Wood ..... A63B 21/00185
482/93

* cited by examiner

MULTI-PURPOSE EXERCISE DEVICE

CROSS-REFERENCE TO RELATED APPLICATION

The present invention claims priority to Provisional Patent Application Ser. No. 62/186,070, filed Jun. 29, 2015, the disclosure of which is hereby expressly incorporated by reference.

FIELD OF THE INVENTION

The present disclosure relates to exercise equipment, specifically to a weight bar device capable of being asymmetrically loaded with weights and/or resistance.

BACKGROUND OF THE INVENTION

In life much of what we lift and carry loads our body asymmetrically. For example, kids, grocery bags, laundry baskets, furniture, golf clubs, suitcases, frying pans, backpacks, and duffle bags do not have a symmetrical weight distribution. We also load asymmetrically with activities like shoveling, swinging golf clubs, tennis rackets, axes, and baseball bats where the distal segment is heavier than the proximal segment. Conversely, most gym and rehab equipment such as dumbbells, bar bells, medicine balls, stability balls, squat, & curl bars, etc, are symmetrical. While some equipment like aquabags and sandbags have a moving center of mass which may provide asymmetry to a movement, this type of equipment is not always consistent with function and cannot be adjusted by the user to mimic a particular activity. To strengthen, condition, and rehabilitate consistently with the way we function, we need equipment that allows us to supplement our symmetrical strengthening programs with asymmetrical exercise and conditioning, and stimulate our proprioceptors to make us more successful with the daily movements we perform. Further, for purposes of variability and versatility, equipment that allows symmetrical and asymmetrical loading would be most beneficial for the user to utilize for functional tasks.

Several pieces of exercise equipment exist which are designed to increase fitness strength and endurance. Many devices have handles in various positions and angles which allow the user to engage different muscles. These existing devices have either a fixed weight, or are designed to be weighted symmetrically with removable weights on each end of a bar. Some devices have a moving center of mass, such as a water filled bag. One problem with all of these existing types of exercise equipment is that they are not authentic to true function. In other words, they are not capable of allowing the user to mimic the asymmetrical loads a body encounters during sports movements or daily activities.

Another type of existing exercise equipment is the "duffle bag" exercise device which allows for asymmetric weighting, however, these devices do not allow for the attachment of different kinds of weights or resistance bands. Further, these types of devices do not provide selective weight distribution in multiple planes to mimic real motion and force. In addition to these prior devices being limited in their overall use, they also have a difficult time in providing resistance in the transverse plane during upright function in conjunction with activation of sagittal and frontal planes.

There is therefore a need for an improved exercise devices which overcomes these and other problems with the prior art.

SUMMARY OF THE INVENTION

The present invention allows users of all abilities to proprioceptively train and rehabilitate their bodies in a manner consistent with realistic function. One aspect of the present invention is an exercise device having multiple handles which allows users the variability to grip and hold symmetrically, asymmetrically, unilaterally, or bilaterally. In one embodiment, the exercise device has at least three arms extending outward from a center frame. Each arm is adapted to independently receive weights or resistance bands to allow the user to control the symmetrical or asymmetrical loading of the weight/resistance. With its preferred three-arm design, weight and resistance band attachments, users are able to load all three planes of motion (sagittal, frontal, transverse) with the same or different amounts of weight/resistance. When the device is placed on the floor, with or without weights, the hand holds are elevated by built in risers allowing users the ability to perform such exercises as push ups, burpees, bear crawls, cart wheels, mountain climbers, and various other on ground tasks from a multitude of positions.

Numerous studies demonstrate the importance of deceleration training for injury reduction and performance enhancement. The ability to asymmetrically torque the body with the present invention helps stimulate the nervous system and train the proprioceptors to a specific sport or just day-to-day activities. Another aspect of the invention includes a method for using an exercise device. The present invention has at least three arms extending outward from a center frame. Each arm is adapted to independently receive weights or resistance bands to allow the user to control the symmetrical or asymmetrical loading of the weight/resistance. The user may load weight or resistance on one or more of the arms to achieve the desired load in all three planes of motion. For example, a user may have the right lateral arm loaded with a weight while holding the present invention upright by handles. The asymmetrical load will provide torque in the frontal plane. Turning the present invention so the weight is at the top of the device while holding on to handles and tilting it anteriorly and posteriorly allows it to generate torque in the sagittal plane. Lastly, attaching a resistance band horizontally from an anchor point while holding onto any other handles and manipulating the present invention in numerous ways allows the user to resist forces in the transverse plane.

For example, the device of the invention can be used by a right-handed pitcher to perform a left leg anterior lunge while performing a throwing motion with the device in the right hand. The deceleration of the mass and momentum of the device functionally trains the posterior rotator cuff muscles and left gluteal complex to decelerate the arm during pitching.

As another example, a basketball player has to deal with boxing out, jumping, and landing with various external forces acting on him/her. These forces require the body to decelerate over a particular distance. A player can use the device of the present invention, i.e. variable torque designed asymmetrical equipment, to train his/her body to successfully decelerate and proprioceptively engage muscles to control motions which might otherwise lead to injury and lost playing time.

As another example, a golfer can grip the device of the present invention and load either of its lateral arms with weights. The golfer can then take the device into his/her back swing to help improve hip, shoulder, and spinal rotation, thereby improving the mobility of the backswing and, consequently, the ability to load and generate more torque with each swing.

Further, day to day activities like lifting grocery bags, moving furniture, pushing and pulling doors, and picking up a moving child all produce a certain amount of stress on muscles, tendons, joints, ligaments, and proprioceptors. In time, if the neuromusculoskeletal system is not properly trained, the body begins to break down. The present invention, as part of a three-dimensional training program, can help individuals successfully train their bodies in preparation for the demands of daily life.

The present invention allows for training in positions consistent with function and sports. Many traditional programs, for example, teach the knee to stay over the toe during a squat or lunge. While this positioning may increase strength for this exact task, it does not promote success during complex movements like decelerating to change direction, or landing from a jump with a defender pushing them, or lunging and pivoting to catch or throw a pass. The present invention can help the individual asymmetrically load his/her body consistent with the demands of a particular sport or daily activities.

The present invention is beneficial over existing devices because it includes hand holds with symmetrical or asymmetrical grip positions and symmetrical or asymmetrical load. It also includes easy weight adjustments on one, two, or three arms, elevated design for comfort with push ups, burpees, mountain climbers, etc. with various grip possibilities. Further, the present invention allows resistance band attachments on each arm, deceleration, strength, endurance, neuromusculoskeletal training, and it has non-traditional hand holds which more closely mirror the positions of your body during everyday activities.

DETAILED DESCRIPTION OF THE INVENTION

Figure 1:
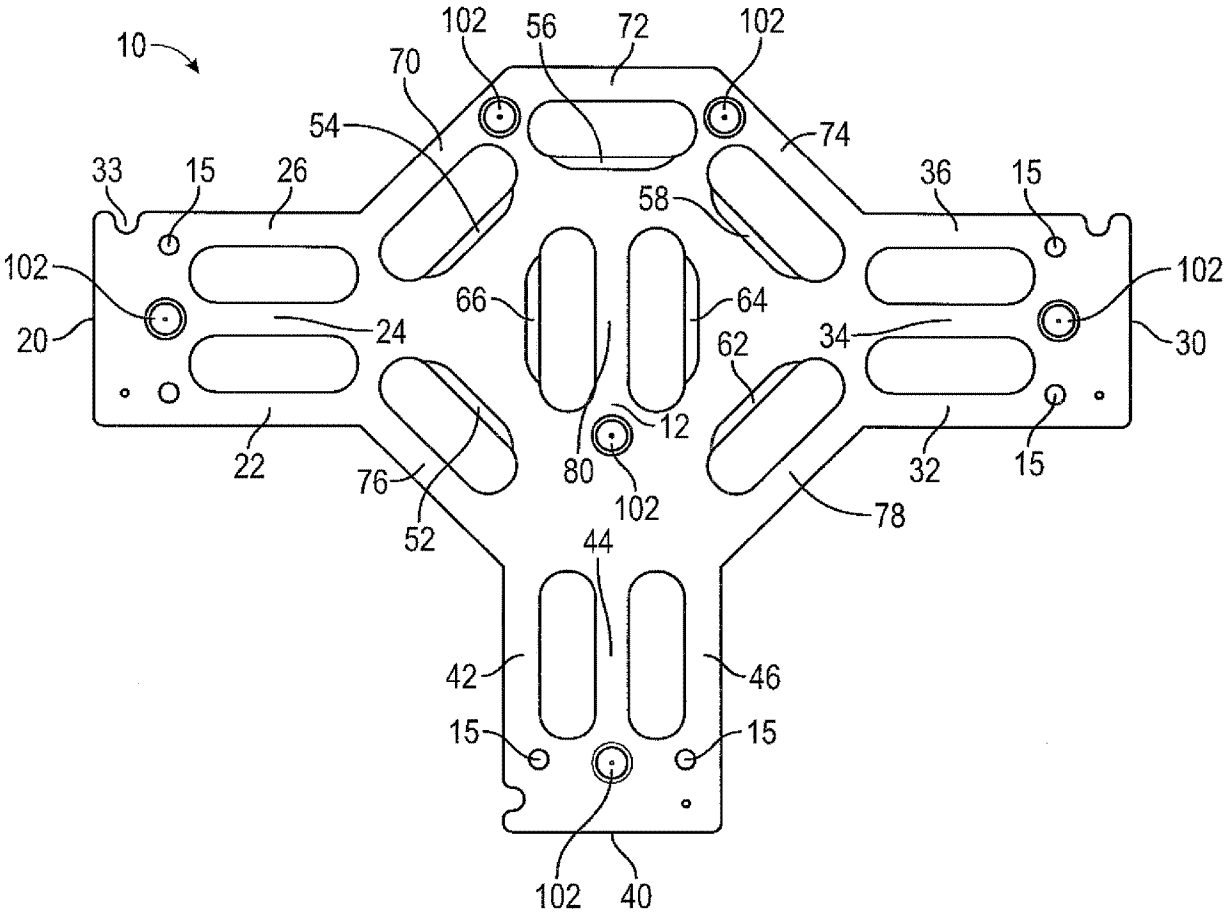
FIG. 1 is a top view of the multi-purpose fitness device showing an exemplary arrangement of the multitude of hand holds for a multitude of functions.

FIG. 1 illustrates a top view of an embodiment of the present invention including an exemplary layout of the multitude of handholds for a multitude of functions and uses. In one embodiment, the present invention consists of a solid structure framework 10 comprising three arms 10, 20, and 30 branching outward from an octagonal center design. When held in its upright position the arms extend off the right and left lateral side and inferior side of the octagon to generally form a "T" shape.

Figure 4:
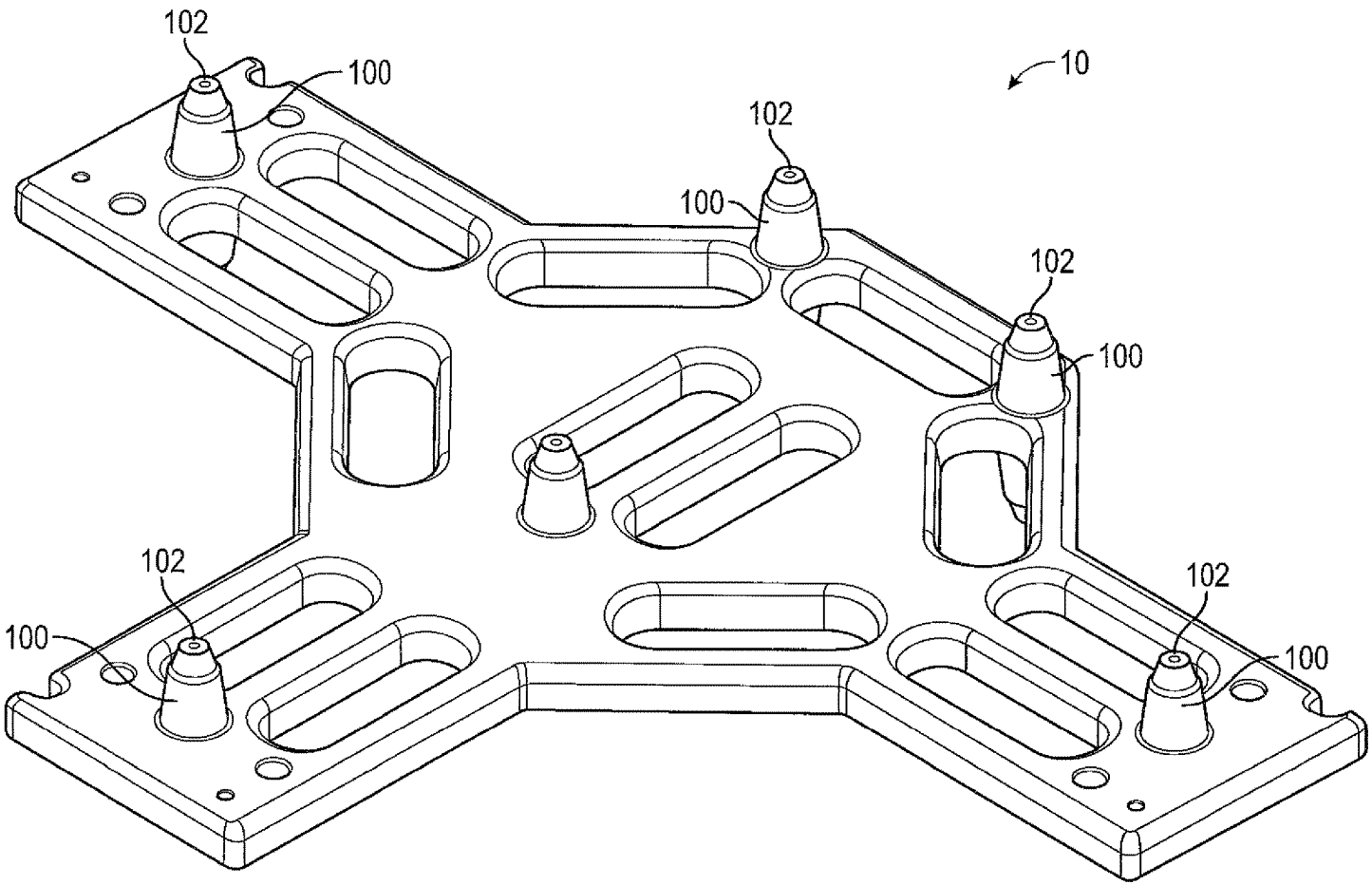
FIG. 4 is a perspective view of the fitness device showing the elevated risers as well as the rubber pads which are screwed onto the risers.

Each arm 10, 20, 30, preferably has at least one full grip handle, with three full grip handles on each arm being preferred. FIG. 1 shows a preferred embodiment that has three full grip handles, 22, 24, 26 on left lateral arm 20, three full grip handles 32, 34, 36 on right lateral arm 30, and three full grip handles 42, 44, 46 on inferior arm 40. The full grip handles on the lateral arms (22, 24, 26 and 32, 34, 36) are preferably mirror images of each other aligned in the same plane while the full grip handles 42, 44, 46 of the inferior arm 40 are preferably aligned generally perpendicular to the full grip handles on the other two arms. The arms 20, 30, and 40 each preferably have at least one opening 15 for attaching resistance bands 3, as shown in FIG. 4 for example. As shown, each arm 20, 30, 40 has two openings 15 located superiorly and inferiorly on the right 30 and left 20 lateral arms, and right and left lateral on the inferior arm 40.

Figure 3:
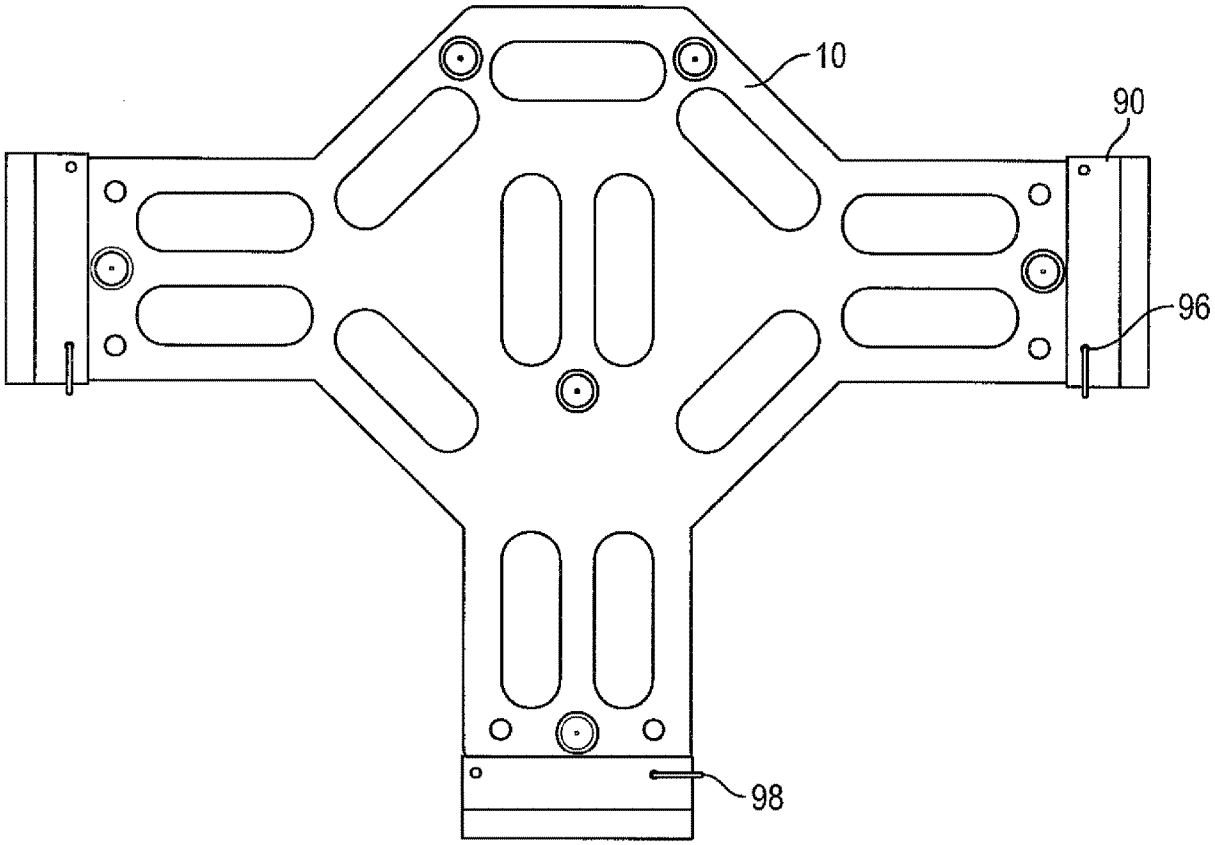
FIG. 3 is a top view of the multi-purpose fitness device showing a weight attached to an arm and secured with a locking slip pin.

The present invention is not limited to the specific arrangement of handholds shown in FIGS. 1, 3 and 4, however, the invention does include multiple hand holds offer varying distances and angles from each other. The handholds are created by elongated openings in the device frame which allow the user to insert his/her hands through the openings and grip a portion of the frame. The handholds may be shaped the same or differently according to the type of grip desired for their use, i.e. C-grip, pinch grip, support grip, intrinsic grip, standard grip, etc.

In the embodiment shown, there are fifteen full grip handles (22-46) and seven intrinsic plus hand holds (52-66). The "intrinsic plus" position is otherwise known in the art as the safe position for hand splinting, whereby the metacarpophalangeal (MCP) joints are flexed at an angle of about 60-70°, the interphalangeal (IP) joints are fully extended, and the thumb is in the first projection. Again, however, the handholds may be of any type and number in the invention.

The center portion of the frame 15 preferably includes grip handles 70, 72, 74, 76, 78 around its outer periphery, preferably arranged at different angles. Specifically, grip handle 72 is aligned in the same plane as the grip handles in the left lateral arm and the right lateral arm. Grip handles 70 and 78 are generally parallel with each other on opposite sides of the frame and grip handles 74 and 76 are generally parallel with each other on opposite sides of the frame. The center portion 12 also includes a full grip handle 80 near its center aligned generally perpendicular to the grip handles in the left lateral arm and the right lateral arm. Other embodiments may include some but not all of the grip handles described herein.

The device has the ability to attach weights 90 of various sizes (FIG. 2) to one, two, or all three of the arms 20, 30, 40. The weights 90 for use with the invention preferably have a gap or "pocket" 92 which allows the weight to be slid onto an arm of the device (FIG. 3). The opposing walls 94 of the weight 90 surround an arm of the device, and bar 93 rests on notch 33 on the arm for secure attachment. The weight 90 includes a hole 96 for an optional locking pin 98 which corresponds to a pin hole 35 on the body of the device 10. Weights may also be attached to the device by other means known in the art, such as by tying the weights to one or more of the arms, hanging the weights from the device, inserting the weights in, for example, a slot in the device, etc.

The weights may be made of any conventional weight materials, such as neoprene, metal, plastic, rubber, etc., with plastic molded weights being preferred. The weights can be of any size, weight, or shape, so long as they have the ability to be attached to the exercise device with the described attachment features.

In one embodiment, the present invention may have overall dimensions of 32.48 inches×24.25 inches×1.125 inches. Larger or smaller devices consistent with the design of the present invention may also be manufactured to provide users a variety of sizes to choose from to suit their individual needs.

The present invention and its components may be manufactured from a variety of materials suitable to withstand a person's body weight distributed across any two of the plurality of handles while elevated on the built in risers. Such materials include, but are not limited to, one or more of metal, metal alloys, graphite, fiberglass, boron, Kevlar, ceramic, rubber, aluminum, wood, plastic, polycarbonate, polyethylene/polypropylene, etc. The preferred manufacturing material is high density polypropylene. The risers are preferably made of a material that is sufficiently sturdy to support the weight of the user but will not mark or scratch the surface upon which it rests. Such materials include, but are not limited to, rubber, carbon rubber, solid rubber, XDR, Duralon, gum rubber, etc.

Figure 5:
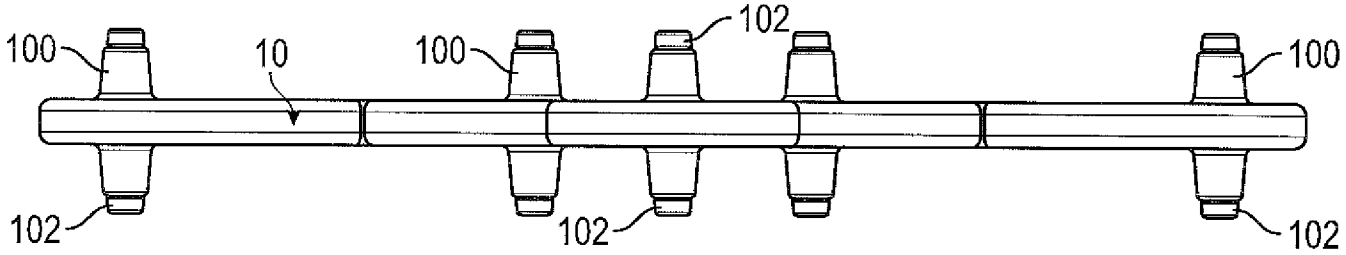
FIG. 5 is a side view of the device showing the effect of the elevated risers which would prevent a users hands from contact with the ground while gripping the hand holds.
Figure 9:
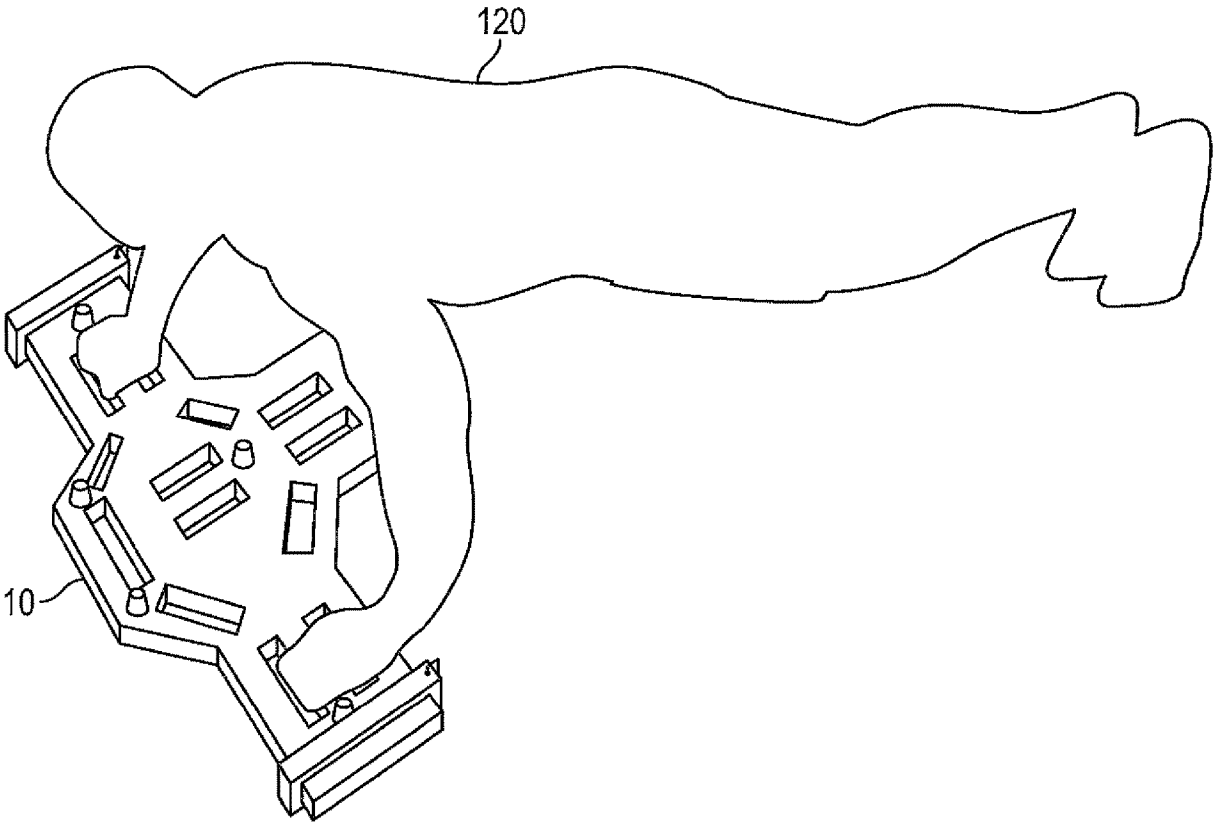
FIG. 9 is a perspective view showing a user using the device for support of body weight as in use for pushups, burpees, mountain climbers, etc.

As shown in FIG. 4, the built in risers 100 provide a platform to elevate the fitness device 10 off the ground to protect a user's hands during movements where the device is set on the ground while the user maintains a grip on the handholds, as also demonstrated in FIG. 5. FIG. 9 shows a user using the device resting on the risers to do such exercises as push-ups, burpees, mountain-climbers, etc. The risers 100 may also be used as hand grips. The risers 100 may be placed on one or both sides of the device.

Figure 2:
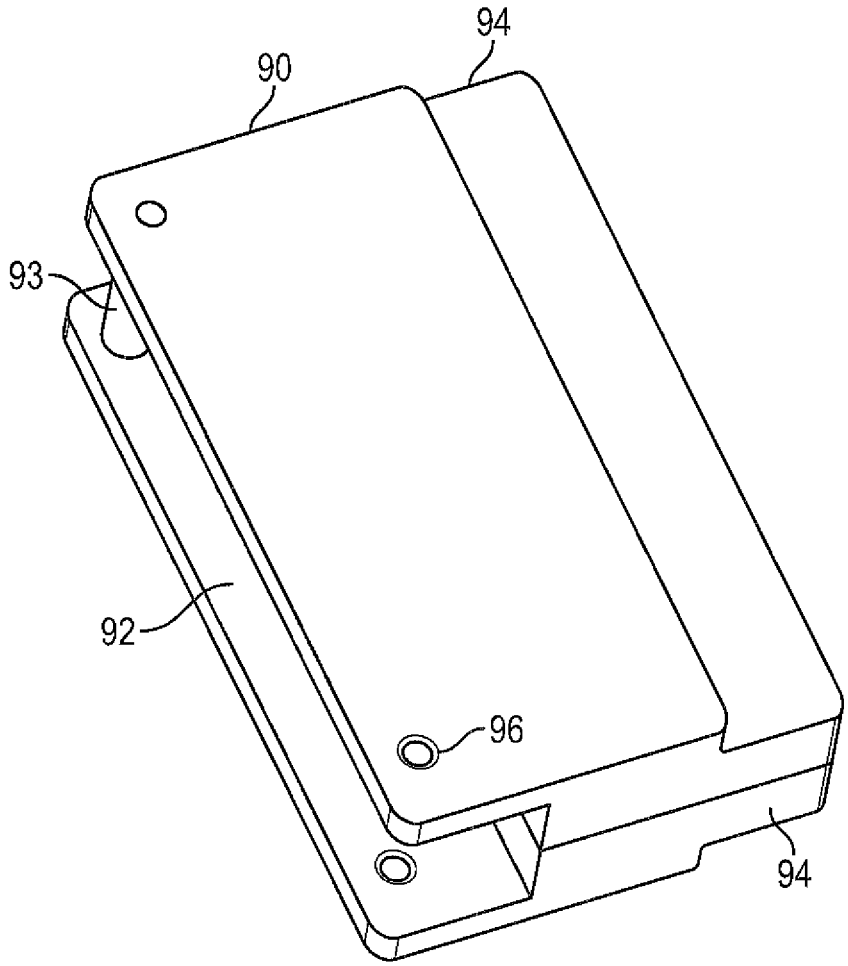
FIG. 2 is a perspective view of the weight attachment with hole for locking pin.
Figure 7:
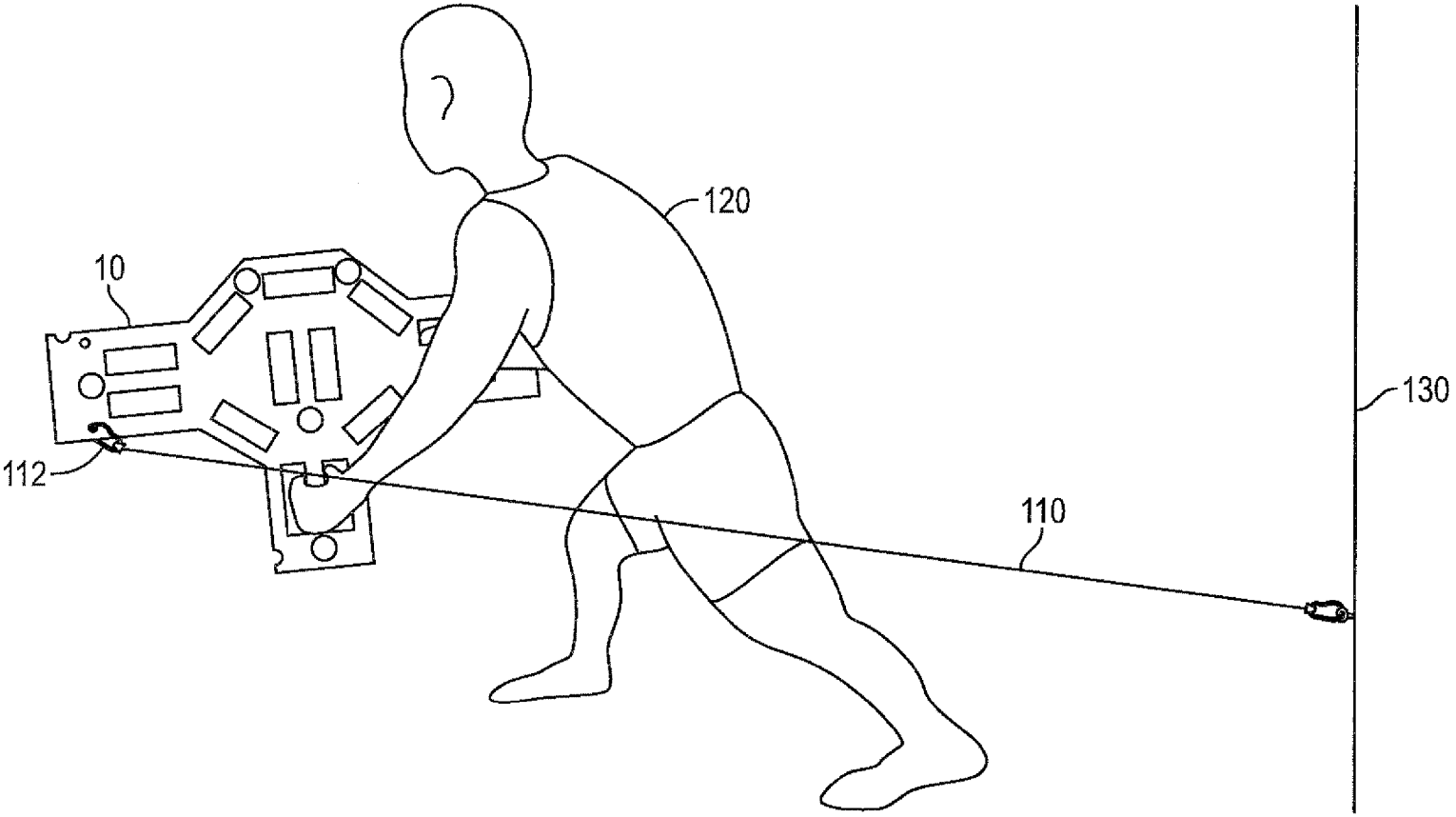
FIG. 7 is a perspective view of a user using the device for exercises with an elastic band attached to the device as well as an anchor point.
Figure 8:
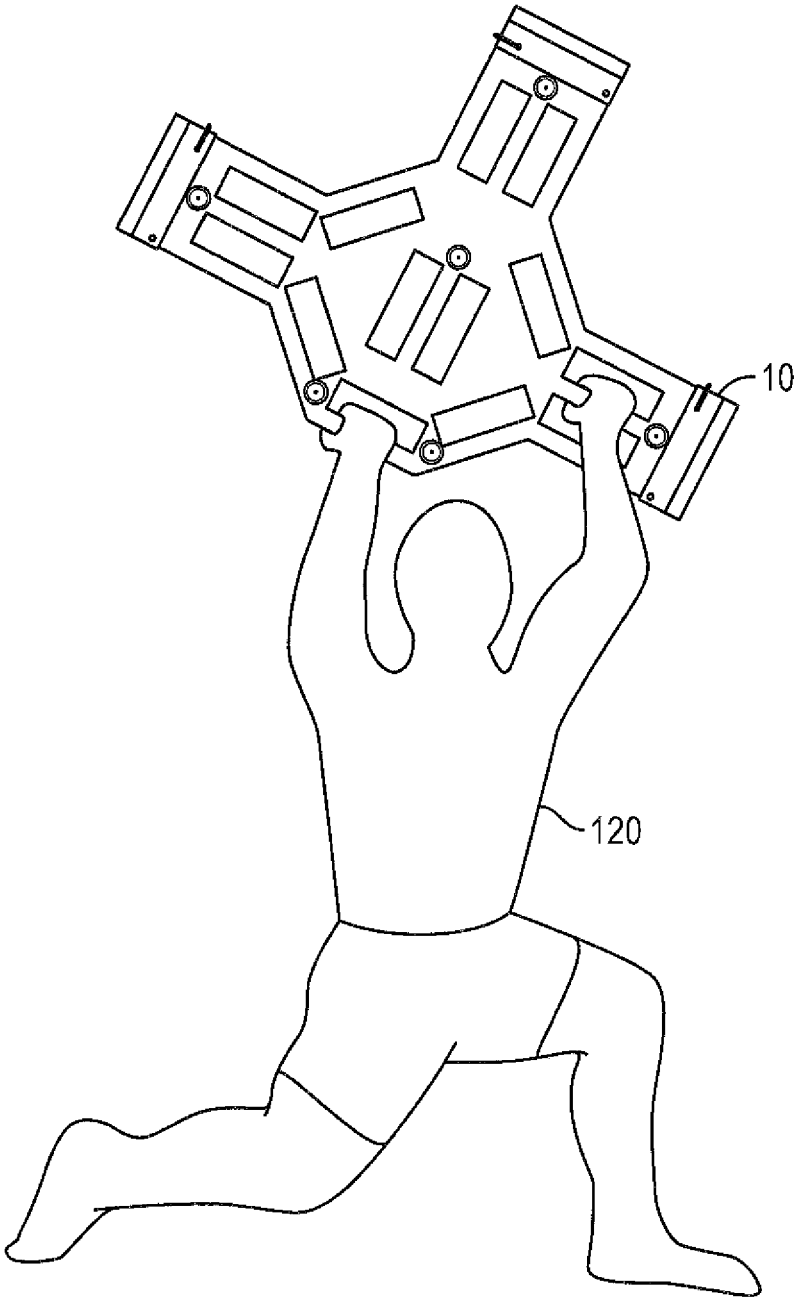
FIG. 8 is a perspective view a user using the device to perform a lunge and raise the device over his/her head

The present invention has the ability to be loaded in all three planes of motion. One aspect of the invention includes a method for using the exercise device. For example, a user may have the right lateral arm 30 loaded with a weight 90 as shown in FIG. 2 while holding the present invention upright by handles 42, 44, and/or 46, as shown in FIG. 8. The asymmetrical load provides torque in the frontal plane. Turning the present invention so the weight is at the top of the device while holding on to handles 26, 24, and/or 22 and tilting it anteriorly and posteriorly allows it to generate torque in the sagittal plane. Lastly, attaching a resistance band horizontally from an anchor point 15 (FIGS. 6 and 7), or numerous other potential attachments points while holding onto any other handles and manipulating the present invention in numerous ways allows the user to resist forces in the transverse plane.

The present invention preferably has three extension arms that can be loaded individually or together. The extension arms may be loaded with weights of different sizes. Each extension arm has built in attachment openings for resistance bands. The ability to load any of one or more of the extension arms at a time, as well as loading one to six built-in resistance band attachments, and a multitude of hand grip positions allows the user to recreate the challenges of lifting or carrying non-uniformly weighted objects that exist in our everyday lives. An example of the variability of the present invention is holding on to handles 42 and 46 while performing floor to overhead reach with one of the lateral extensions loaded. A quick and easy adjustment that changes the demand of the activity is to move a handhold from 42 or 46 and hold handle 44. These subtle changes increase the variability of the present invention, change the torque and demand, and help prepare the user for a multitude of functional life activities.

Figure 6:
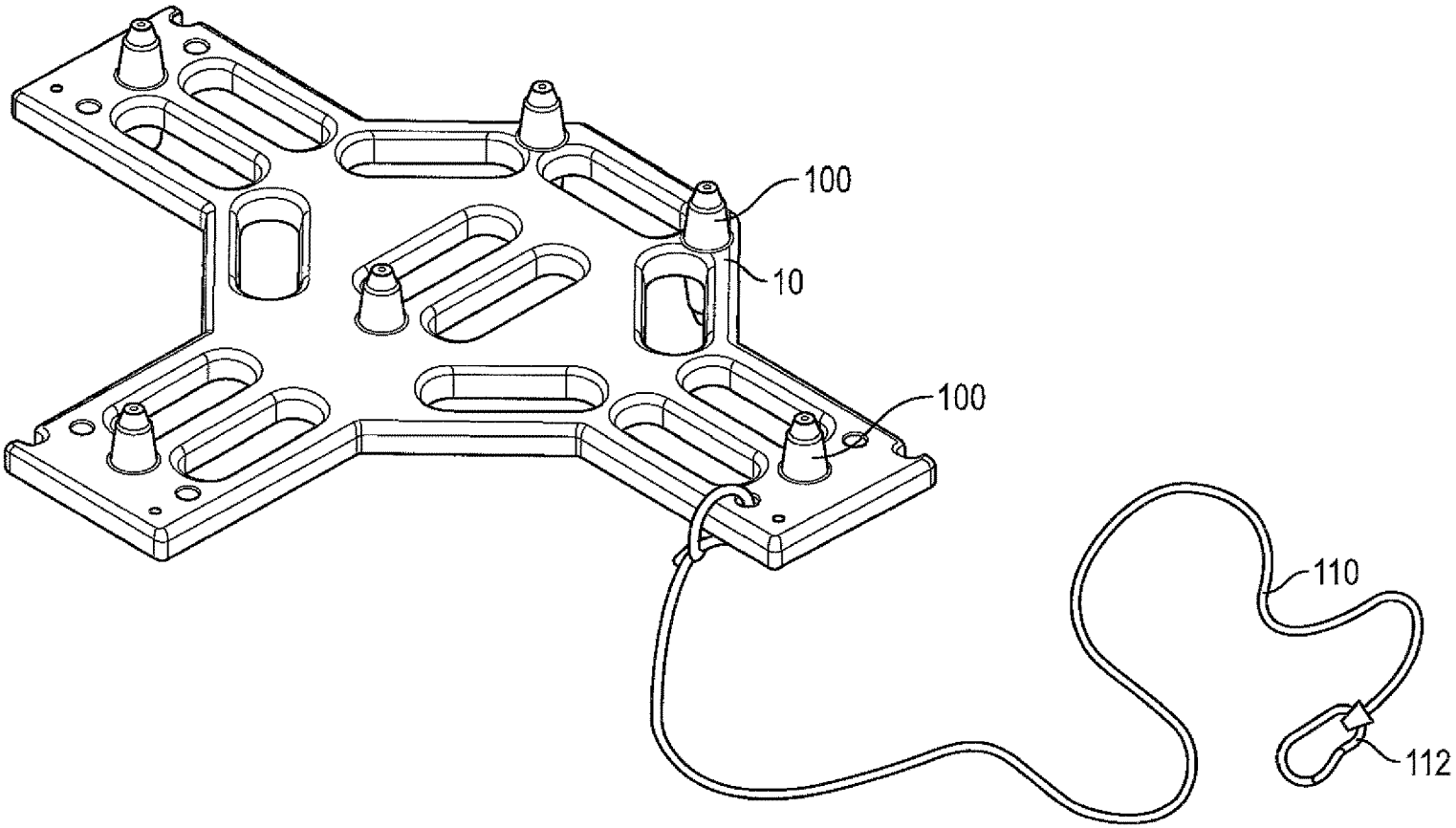
FIG. 6 is a perspective view of the device showing an elastic band attached to an opening in one of the arms as well as an anchor point at any verticality.

FIG. 6 depicts the present invention with a resistance band 110 combined with the device 10 through an opening 15 in one of the arms. Depending on the goals of the user, the present invention may be used with one or both attachment sites on one, two, or all three arms, and can be connected to resistance bands by tying the band directly to the device, or using a carabiner 112 or other suitable attachment device, such as a hook or clip, that fits into or engages with opening 15. The present invention may be used with a resistance band 110 or bands and/or a weight 90 on any of the one, two, or three arms at the same time. The resistance bands may be anchored at any appropriate location, such as a door, door frame, pole, tree, etc. necessary to produce the torque, force, or resistance required or deemed appropriate by the user. FIG. 7 shows one such arrangement whereby the resistance band 110 is anchored to a stationary object such as a door 130 to provide the necessary horizontal resistance for the user 120. Resistance bands may also be used to connect two devices 10 of the invention together in which case two users each with a device 10 can simultaneously engage the devices in opposite directions to produce resistance.

FIG. 7 depicts a user 120 performing an exercise with the device 10 of the present invention connected to a resistance band 110 and carabiner 112. One or two resistance band attachment sites on any of the one, two, or three arms may be connected depending on how the user will utilize the present invention.

FIG. 8 shows one upright functional activities with the present invention, a lunge with overhead reach. The amount of torque or force the body must control can be easily varied by the load, or by the orientation of the device 10. The same exercise or other exercises may be performed while holding any other possible combinations of handles with any one, two, or all three arms loaded with weight and/or resistance bands. In addition to lunges, the user may 120 may choose to load the device while performing squats, dead lifts, jumps, hops, cleans, jerks, swings, chops, presses, balance reaches, etc.

FIG. 9 shows a user 120 performing one of the many varieties of push-ups, multiple hand hold mountain climbers, or multiple hand hold burpees with the present invention 10. The present invention has the capability of being elevated via the built in risers to perform these exercises or others deemed appropriate by the user. When all three arms are loaded with either weights or spacers, the present invention can be used to generate torque to the body in upright function and it can be quickly moved to on ground activities as well.

The foregoing description has been presented for the purposes of illustration and description. It is not intended to be an exhaustive list or limit the invention to the precise forms disclosed. It is contemplated that other alternative processes and methods obvious to those skilled in the art are considered included in the invention. The description is merely examples of embodiments. For example, the exact location of the handholds, grips, arms, notches, elastic band attachment sites, openings, etc. may be varied according to the type of exercise, desired performance of the user, etc. It is understood that any other modifications, substitutions, and/or additions may be made, which are within the intended spirit and scope of the disclosure. From the foregoing, it can be seen that the exemplary aspects of the disclosure accomplishes at least all of the intended objectives.

The invention claimed is:

1. A multi-purpose handheld exerciser having a top and bottom side comprising:

a rigid center frame;

at least three arms branching outwardly from and in the same plane as the center frame;

whereby each of the arms includes at least one grip handle; and risers on the bottom side of the exerciser to elevate the exerciser and prevent a user's hands from touching the floor when gripping the handholds;

further providing that each of the arms can be independently loaded with one or more removable weights to produce a symmetric or asymmetric weight load;

whereby two of the arms branch out laterally from the center frame and the third arm branches perpendicularly from the center frame with respect to the first two arms to form a "T" shape when the exerciser is held in an upright position.

2. The handheld exerciser of claim 1 whereby the center frame is octagonal.

3. The handheld exerciser of claim 1 whereby each of the arms has three grip handles.

4. The handheld exerciser of claim 3 whereby the grip handles on the two arms that branch out laterally from the center frame are mirror images of each other aligned in the same plane as the center frame.

5. The handheld exerciser of claim 1 further including at least one handhold in the center frame.

6. The handheld exerciser of claim 1 further including at least one attachment site for a resistance band.

7. The handheld exerciser of claim 6 whereby the resistance band clips to the exerciser through an opening in one of the arms of the exerciser.

8. A multi-purpose handheld exerciser having a top and bottom side comprising:

a rigid center frame;

at least three arms branching outwardly from and in the same plane as the center frame;

whereby each of the arms includes at least one grip handle; and risers on the bottom side of the exerciser to elevate the exerciser and prevent a user's hands from touching the floor when gripping the handholds;

further providing that each of the arms can be independently loaded with one or more removable weights to produce a symmetric or asymmetric weight load;

whereby each of the arms has at least one opening suitable for attachment of a resistance band.

9. The handheld exerciser of claim 8 whereby each of the arms has two openings located superiorly and inferiorly on the arms.

10. A multi-purpose handheld exerciser having a top and bottom side comprising:

a rigid center frame;

at least three arms branching outwardly from and in the same plane as the center frame;

whereby each of the arms includes at least one grip handle;

risers on the bottom side of the exerciser to elevate the exerciser and prevent a user's hands from touching the floor when gripping the handholds;

further providing that each of the arms can be independently loaded with one or more removable weights to produce a symmetric or asymmetric weight load; and at least one attachment point on at least one of the arms for a weight;

whereby the weight is attached to the arm by sliding the weight onto the end of the arm through an aperture in the arm.

11. The handheld exerciser of claim 10 further including a hole in the arm which receives a locking pin from the weight.

12. A multi-purpose handheld exerciser having a top and bottom side comprising:

a rigid center frame;

three arms branching outwardly from and in the same plane as the center frame, whereby two of the arms branch out laterally from the center frame and the third arm branches perpendicularly from the center frame with respect to the first two arms to form a "T" shape when the exerciser is held in an upright position;

whereby each of the arms includes three hand holds;

whereby each of the anus includes at least one attachment site for a weight and at least one attachment point for an elastic band.

13. The multi-purpose handheld exerciser of claim 12 whereby the weight includes a pocket, an aperture between two walls, whereby the weight attaches to the exerciser by sliding the aperture through the arm of the exerciser and the walls surround the end of the arm.

14. The multi-purpose handheld exerciser of claim 13 whereby a bar between the walls of the weight fits onto a notch in the arm of the exerciser.

15. The multi-purpose handheld exerciser of claim 13 further including a locking pin placed through the walls of the weight through a corresponding hole in the arm.

16. A method of exercising using the multi-purpose handheld exerciser of claim 1, including the steps of: gripping one or more of the handles of the exerciser;

and holding the exerciser in a manner selected from the group consisting of symmetrically, asymmetrically, unilaterally, and bilaterally.

17. The method of claim 16 whereby the exerciser is used in an activity selected from the group consisting of pushups, squats, dead lifts, jumps, hops, cleans, jerks, swings, chops, presses, balance reaches, lunges, mountain climbers, and burpees.

* * * * *